US008517437B2

(12) United States Patent
Zhang

(10) Patent No.: US 8,517,437 B2
(45) Date of Patent: Aug. 27, 2013

(54) SEALING FASTENER

(75) Inventor: Lei Zhang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 279 days.

(21) Appl. No.: 13/014,732

(22) Filed: Jan. 27, 2011

(65) Prior Publication Data

US 2012/0133158 A1 May 31, 2012

(30) Foreign Application Priority Data

Nov. 30, 2010 (CN) ..... 2010 1 0565812

(51) Int. Cl.
*B65D 27/30* (2006.01)

(52) U.S. Cl.
USPC ..... 292/307 A; 292/307 R

(58) Field of Classification Search
USPC ..... 292/307 A, 308–326, 307 R, 307 B
See application file for complete search history.

(56) References Cited

U.S. PATENT DOCUMENTS

| | | | | |
|---|---|---|---|---|
| 1,982,438 | A * | 11/1934 | Keidel | 292/325 |
| 4,609,218 | A * | 9/1986 | Chevillard et al. | 292/320 |
| 5,568,952 | A * | 10/1996 | Ruegg | 292/318 |
| 6,174,006 | B1 | 1/2001 | Burt | |
| 6,981,725 | B2 * | 1/2006 | Debrody et al. | 292/307 R |
| 7,360,806 | B2 * | 4/2008 | Ching | 292/307 R |

FOREIGN PATENT DOCUMENTS

GB 2265114 A 9/1993

* cited by examiner

*Primary Examiner* — Carlos Lugo
*Assistant Examiner* — Mark Williams
(74) *Attorney, Agent, or Firm* — Altis Law Group, Inc.

(57) ABSTRACT

A plastic sealing fastener includes a fixing member, a latching strip fixed on the fixing member and a cover mounted on the fixing member. The fixing member defines a locking hole through which the latching strip passes. The fixing member forms a plurality of elastic teeth locking the latching strip in the locking hole. The cover defines a covering hole communicating with the locking hole through which the latching strip passes. A diameter of the covering hole is less than that of the locking hole.

6 Claims, 4 Drawing Sheets

SEALING FASTENER

CROSS-REFERENCE TO RELATED APPLICATIONS

This application is related to two co-pending U.S. patent applications which are application Ser. Nos. 13/014,733 and 13/014,731, and entitled "SEALING FASTENER". In the co-pending applications, the inventor is LEI ZHANG. The co-pending application have the same assignee as the present application. The disclosure of the above identified application is incorporated herein by reference.

BACKGROUND

1. Technical Field

The present disclosure relates generally to security, and especially to a plastic sealing fastener for securing closures.

2. Description of Related Art

A commonly used plastic sealing fastener includes a fixing member and a latching strip thereon. The fixing member defines a locking hole. The latching strip is latched in the locking hole for securing a closure. However, the plastic sealing fastener is easily unlocked by moving the latching strip using an ordinary tool such as a metal strip.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Figure 1:
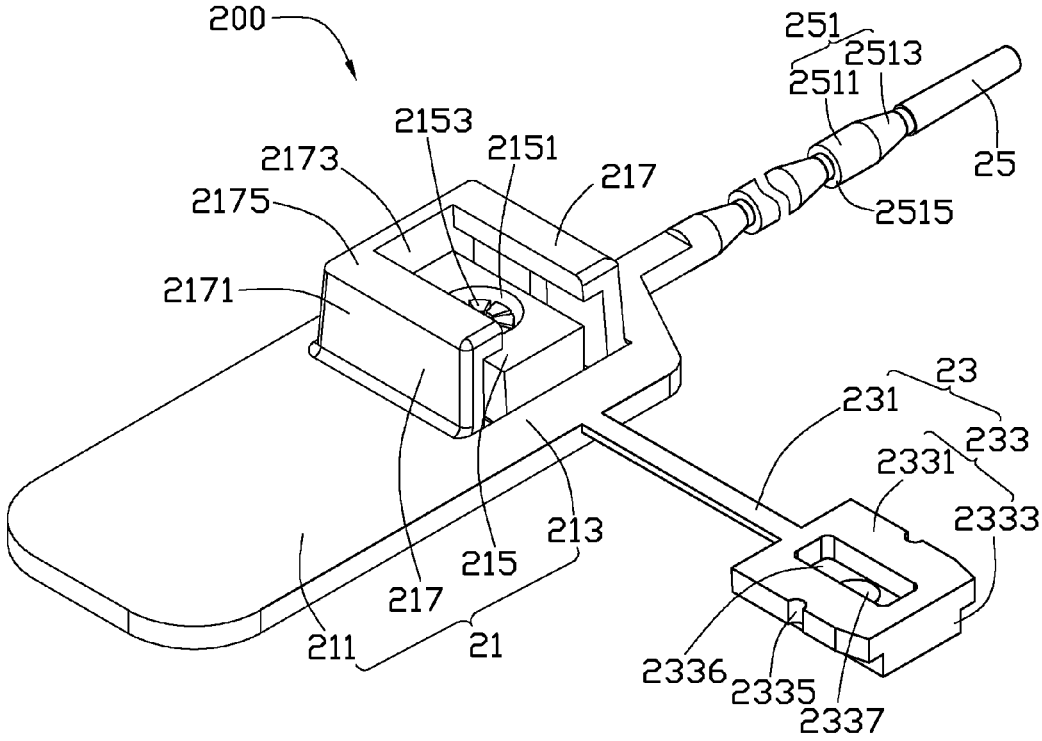
FIG. 1 is an isometric view of an embodiment of a plastic sealing fastener including a fixing member and a cover.
Figure 2:
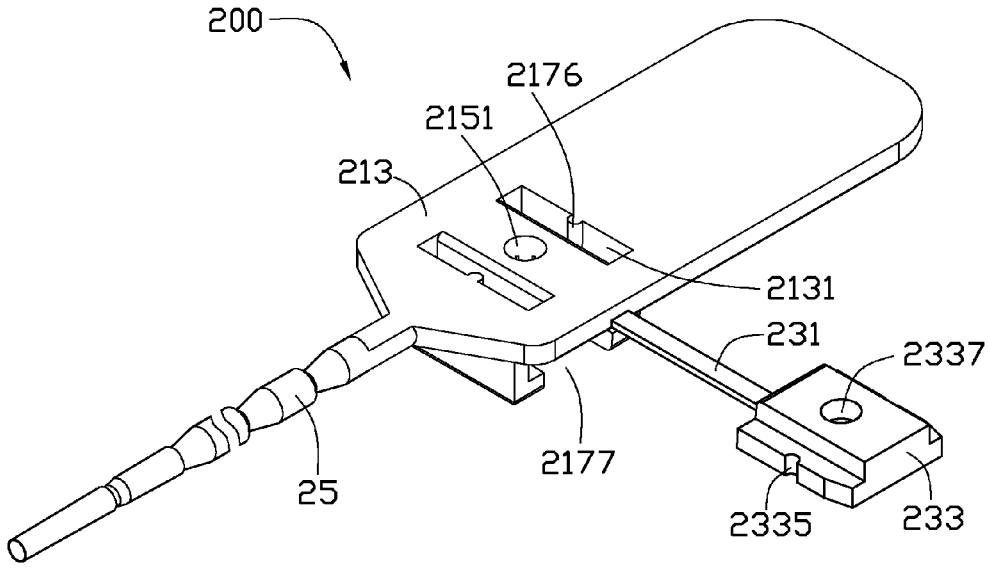
FIG. 2 is an isometric view of the plastic sealing fastener of FIG. 1, shown in another aspect.

Referring to FIGS. 1 and 2, an embodiment of a plastic sealing fastener 200 includes a substantially rectangular fixing member 21, a cover 23 mounted on the fixing member 21 and a latching strip 25 fixed on the fixing member 21.

The fixing member 21 includes a labeling portion 211, a fixing portion 213, a receiving portion 217 formed on the fixing portion 213 and a rectangular locking portion 215 in the receiving portion 217. The labeling portion 211 supports a label (not shown) thereon, for providing information of an object to be secured, such as a serial number or other. The locking portion 215 defines a circular locking hole 2151, and forms a plurality of elastic teeth 2153 on a sidewall of the locking hole 2151. The plurality of teeth 2153 cooperatively define a through hole 2155 (FIG. 4) therebetween, through which the latching strip 25 pass through. The receiving portion 217 receives the locking portion 215 and fixes the cover 23. The receiving portion 217 includes two sidewalls 2171, extending from the fixing portion 213, opposite to each other, a rear wall 2173 extending from the fixing portion 213 and a top surface 2175 covering the two sidewalls 2171 and the rear wall 2173. The rear wall 2173 connects the two sidewalls 2171. The two sidewalls 2171 and the top surface 2175 cooperatively define an opening (not labeled) facing the cover 23, acting as an entrance to the receiving portion 217. Each sidewall 2171 forms a positioning rib 2176 extending from the fixing portion 213. The receiving portion 217 defines a guide slot 2177 communicating with the opening. The fixing portion 213 defines a slot 2131 between the sidewall 2171 and the locking portion 215, and thus is more easily manufactured by molding.

The cover 23 includes a longitudinal connecting portion 231, adjacent to the opening of the receiving portion 217, and a rectangular main body 233. The connecting portion 231 moveably connects the main body 233 to the fixing portion 213. The connecting portion 231 is fixed to the main body 233 and the fixing portion 213 by opposite ends. The connecting portion 231 is flexible and capable of bending. The main body 233 includes a base portion 2331 and a covering portion 2333 formed on the base portion 2331. The covering portion 2333 corresponds to the guide slot 2177, such that the cover 23 can be received in the receiving portion 217 through the opening, and the covering portion 2333 can be received in the guide slot 2177. The base portion 2331 defines a positioning slot 2335 at each side thereof corresponding to one of the positioning ribs 2176 of the receiving portion 217. The base portion 2331 defines a longitudinal contraction slot 2336, to prevent the cover 23 from deforming when molded. When the cover 23 is received in the receiving portion 217, the positioning rib 2176 of the receiving portion 217 is received in the positioning slot 2335, thus to fix the cover 23 in the receiving portion 217. The covering portion 2333 defines a circular covering hole 2337 communicating with the contraction slot 2336. A diameter of the covering hole 2337 is substantially equal to a width of the contraction slot 2336, and less than the diameter of the locking hole 2151, but exceeds that of the latching strip 25, and the covering hole 2337 is through which the latching strip 25 passes.

The latching strip 25 extends from an end of the fixing portion 213 away from the labeling portion 211. The latching strip 25 includes a plurality of latching portions 251 along the length thereof, each of the latching portion 251 including a cylindrical portion 2511 adjacent to the fixing member 21 and a tapered portion 2513 away from the fixing member 21. Each cylindrical portion 2511 forms a locking surface 2515 adjacent to the tapered portion 2513.

Figure 3:
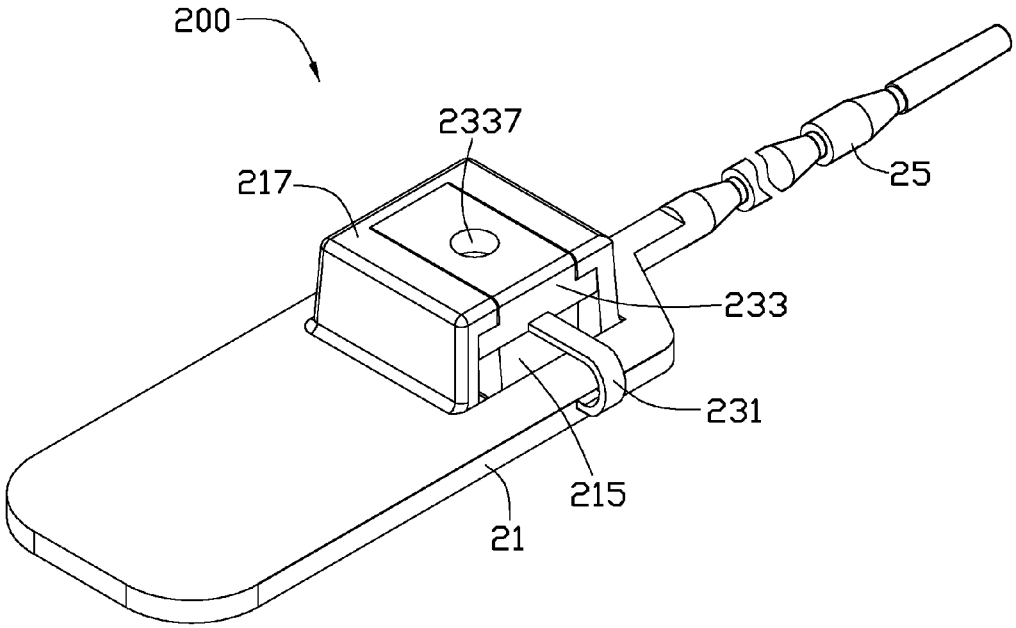
FIG. 3 is an isometric view of a plastic sealing fastener of FIG. 1, with the cover fixed on the fixing member.
Figure 4:
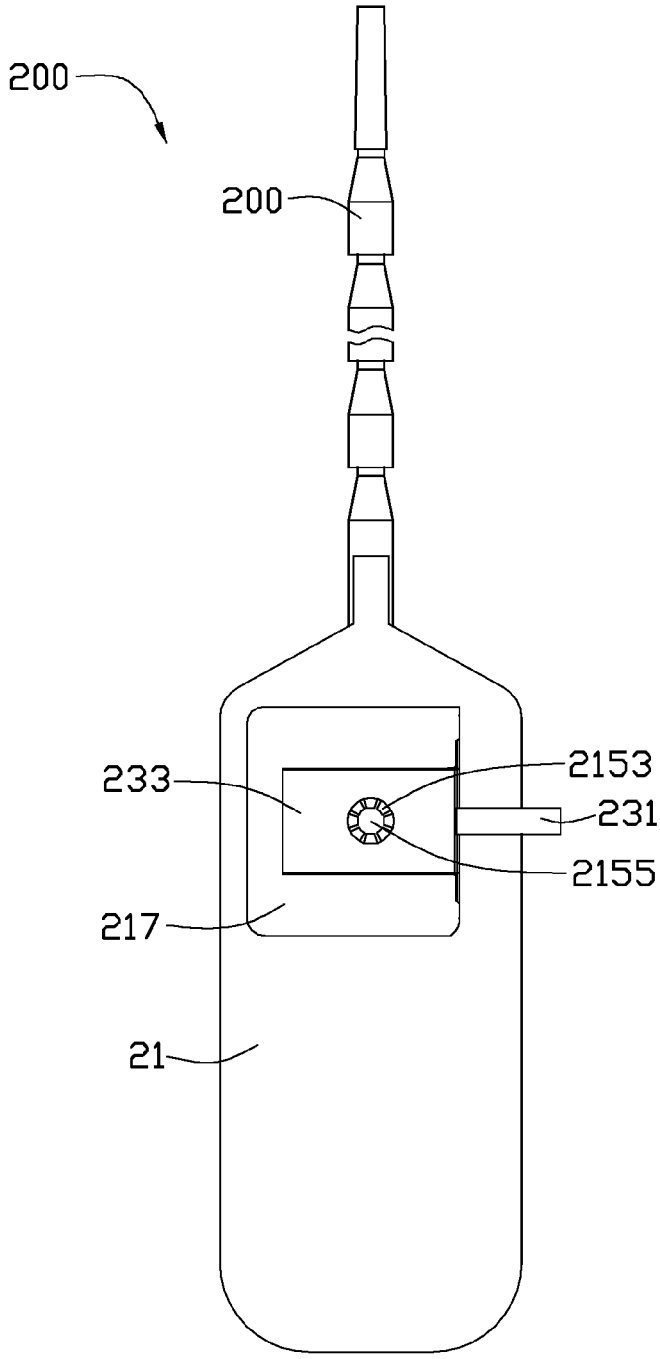
FIG. 4 is a top view of the plastic sealing fastener of FIG. 1.

Referring to FIGS. 3 and 4, in use, the main body 233 of the cover 23 is received in the receiving portion 217 and above the locking portion 215 through the opening. The covering portion 2333 is received in the guide slot 2177. The positioning rib 2176 is latched in the positioning slot 2335 to fix the main body 233 in the receiving portion 217 and bending the connecting portion 231. A free end of the latching strip 25 away from the fixing member 21 passes through the object to be secured, the locking hole 2151 of the locking portion 215, the contraction slot 2336 and the covering hole 2337 of the cover 23 in that order. The teeth 2153 in the locking hole 2151 resists one locking surface 2515 of the latching portion 251, thus to fix the latching strip 25 in the locking hole 2151. The locking hole 2151 is at least partially covered by the cover 23, thus the plastic sealing fastener 200 cannot be unlocked using simple tools such as metal strips, thereby suffering irreparable damage before the object is opened.

The plastic sealing fastener 200 can be used in customs for sealing a plurality of objects to be imported and exported, and to secure goods. When a plurality of plastic sealing fasteners 200 is employed for an equal number of objects, each plastic sealing fastener 200 can be labeled at the labeling portion 211 with a unique identification number, to further improve security.

It is believed that the present embodiments and their advantages will be understood from the foregoing description, and it will be apparent that various changes may be made thereto without departing from the spirit and scope of the disclosure or sacrificing all of its material advantages.

What is claimed is:

1. A plastic sealing fastener comprising:

a fixing member;

a latching strip fixed on the fixing member; and a cover mounted on the fixing member, wherein the fixing member defines a locking hole for the latching strip passing through, the fixing member forms a plurality of elastic teeth for locking the latching strip in the locking hole, the cover defines a covering hole communicating with the locking hole for the latching strip passing through, and a diameter of the covering hole is less than a diameter of the locking hole, the fixing member comprises a fixing portion and a receiving portion on the fixing portion, the receiving portion forms a pair of positioning ribs extending from the fixing portion, the cover comprises a main body and a connecting portion, the connecting portion is fixed to the main body and the fixing portion by opposite ends, the main body defines a positioning slot at each side thereof, the connecting portion is capable of bending, when the connecting portion is bended, the main body is capable of being received in the receiving portion, the pair of positioning ribs is latched in the pair of positioning slots to position the main body in the receiving portion.

2. The plastic sealing fastener of claim 1, wherein the main body comprises a base portion and a covering portion on the base portion, the covering hole is defined on the covering portion, the base portion defines a contraction slot communicating with the covering hole.

3. The plastic sealing fastener of claim 2, wherein the positioning slot is defined in the base portion, the fixing member further comprises a locking portion received in the receiving portion, the locking hole is defined in the locking portion.

4. The plastic sealing fastener of claim 3, wherein the fixing member further comprises a labeling portion for pasting a label thereon.

5. The plastic sealing fastener of claim 3, wherein the receiving portion defines a guide slot corresponding to the covering portion of the cover.

6. The plastic sealing fastener of claim 1, wherein the latching strip comprises a plurality of latching portions arranged along a longitudinal direction of the latching strip end to end, each latching portion comprises a cylindrical portion and a tapered portion, each cylindrical portion forms a locking surface adjacent to the tapered portion, and the teeth of the fixing member resist the locking surface to fix the locking surface.

* * * * *